US007118193B2

(12) United States Patent
Kaneko et al.

(10) Patent No.: US 7,118,193 B2
(45) Date of Patent: Oct. 10, 2006

(54) LIQUID EJECTING RECORDING HEAD AND LIQUID EJECTING RECORDING APPARATUS

(75) Inventors: Mineo Kaneko, Tokyo (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/235,279

(22) Filed: Sep. 27, 2005

(65) Prior Publication Data

US 2006/0071969 A1 Apr. 6, 2006

Related U.S. Application Data

(62) Division of application No. 09/742,431, filed on Dec. 22, 2000, now Pat. No. 6,964,467.

(30) Foreign Application Priority Data

Dec. 22, 1999 (JP) ..... 1999-364078

(51) Int. Cl.
*B41J 2/21* (2006.01)

(52) U.S. Cl. ..... 347/43; 347/40

(58) Field of Classification Search ..... 347/43, 347/15, 40, 12

See application file for complete search history.

(56) References Cited

U.S. PATENT DOCUMENTS

| | | | |
|---|---|---|---|
| 4,528,576 | A | 7/1985 | Koumura et al. |
| 4,593,295 | A | 6/1986 | Matsufuji et al. |
| 5,164,747 | A | 11/1992 | Osada et al. |
| 5,166,699 | A | 11/1992 | Yano et al. |

(Continued)

FOREIGN PATENT DOCUMENTS

| | | | |
|---|---|---|---|
| EP | 0 244 643 | A | 11/1987 |

(Continued)

OTHER PUBLICATIONS

Note: Counterpart U.S. Patent Nos. 5,621,524 and 5,697,144 also cited.

*Primary Examiner*—Lamson Nguyen
(74) *Attorney, Agent, or Firm*—Fitzpatrick, Cella, Harper & Scinto

(57) ABSTRACT

A liquid ejection recording head for effecting recording by ejecting first liquid and second liquid which is a different kind of liquid through different ejection outlets, while bidirectionally scanning a recording material in a scanning direction includes a group of first ejection outlet arrays each of which has a plurality of ejection outlets at predetermined intervals arranged in a direction different from the scanning direction, wherein corresponding ejection outlets in the respective ejection arrays are aligned in the scanning direction; a group, disposed adjacent the group of the first ejection outlet arrays, of second ejection outlet arrays arranged in a manner similar to the first ejection outlet array group; wherein the first ejection outlet arrays include a first ejection outlet array for ejecting the first liquid and a second ejection outlet array for ejecting the second liquid; wherein the second ejection outlet arrays include a third ejection outlet array for ejecting the first liquid and a fourth ejection outlet array for ejecting the second liquid; wherein the first ejection outlet array group and the second ejection outlet array group are disposed such that first ejection outlet array and third ejection outlet array are adjacent to each other and that ejection outlets of the first ejection outlet array and the ejection outlets of the third ejection outlet array are disposed with deviation in a direction of arrangement of the ejection outlets so as to be complementary to each other in the scanning direction.

14 Claims, 9 Drawing Sheets

U.S. PATENT DOCUMENTS

| | | | |
|---|---|---|---|
| 5,343,227 | A | 8/1994 | Hirosawa et al. |
| 5,367,324 | A | 11/1994 | Abe et al. |
| 5,367,325 | A | 11/1994 | Yano et al. |
| 5,565,899 | A | 10/1996 | Sugimoto et al. |
| 5,621,524 | A | 4/1997 | Mitani |
| 5,682,190 | A | 10/1997 | Hirosawa et al. |
| 5,697,144 | A | 12/1997 | Mitani et al. |
| 5,877,785 | A | 3/1999 | Iwasaki et al. |
| 5,956,056 | A | 9/1999 | Kaneko et al. |
| 6,137,510 | A | 10/2000 | Sato et al. |
| 6,139,130 | A | 10/2000 | Takahashi et al. |
| 6,139,761 | A | 10/2000 | Ohkuma |
| 6,315,387 | B1 | 11/2001 | Horikoshi |
| 6,964,467 | B1 * | 11/2005 | Kaneko et al. ..... 347/40 |

FOREIGN PATENT DOCUMENTS

| | | |
|---|---|---|
| EP | 0 955 174 A | 11/1999 |
| JP | 58-215352 | 12/1983 |
| JP | 62-264957 | 11/1987 |
| JP | 1-208143 | 8/1989 |
| JP | 8-207291 | 8/1996 |
| JP | 8-207320 | 8/1996 |
| JP | 9-11479 | 1/1997 |
| JP | 10-140487 | 5/1998 |
| JP | 11-320926 | 11/1999 |
| WO | WO 91/08902 | 6/1991 |

* cited by examiner

LIQUID EJECTING RECORDING HEAD AND LIQUID EJECTING RECORDING APPARATUS

This is a divisional application of application Ser. No. 09/742,431, filed Dec. 22, 2000 now U.S. Pat. No. 6,964, 467, now allowed.

BACKGROUND OF THE INVENTION

FIELD OF THE INVENTION

The present invention relates to a liquid ejecting recording head and a liquid ejection recording apparatus, which apply various liquids, for example, inks different in color, to recording media, for example, a sheet of paper. In particular, it relates to a liquid ejecting recording head and a liquid ejecting recording apparatus, which are employed by a bidirectional printing apparatus, that is, a printing apparatus capable of recording in either the forward or backward direction by moving a recording head in a manner to scan a piece of recording medium.

In the field of a printing apparatus, in particular, an ink jet type printing apparatus, improvement in recording speed in color mode is an essential theme. As means for improving recording speed, increasing the frequency with which a recording head is driven, and bidirectional printing, are generally considered, in addition to lengthening a recording head. In bidirectional printing, the energy necessary for printing is virtually uniformly distributed throughout the time spent for an actual printing process. Thus, bidirectional printing is more effective compared to unidirectional printing, in terms of total operational cost.

However, bidirectional printing suffers from an inherent problem. That is, it is liable to produce color anomaly in the form of stripes. This is due to the fact that in a printing apparatus of a bidirectional printing type, the order in which various color inks are applied when the printing head is moved in one direction in the primary scanning direction is different from the order in which various color inks are applied when it is moved in the other direction in the primary scanning direction; admittedly the extent of the color anomaly is related to printing head configuration. Since this problem is caused by the order in which inks are applied, overlapping of dots different in color results in a certain amount of color aberration, no matter how small the amount of the overlapping.

Laid-Open Japanese Patent Application 58-208,143/1983 discloses a liquid ejecting recording head structure for solving the above described problem. According to this patent application, nozzles for different color inks are aligned in the secondary scanning direction.

Laid-Open Japanese Patent Application 58-179,653/1983 discloses a liquid ejection recording head structure which comprises a nozzle set for the forward direction and a nozzle set for the returning direction. According to this patent application, one set of nozzles is used when moving a recording head in one direction, and another set of nozzles is used when moving the recording head in the opposite direction; in other words, a switch in nozzle set is made depending on, in which direction in the primary scanning direction a recording head is moved. The recording head in this patent application comprises a combination of a yellow ink ejecting recording head (Y recording head), a magenta ink recording head (M recording head), a cyan ink recording head (C recording head), and a black ink recording head (Bk recording head).

Further, Japanese Laid-Open Patent Application 58-215, 352/1983 discloses a recording head structure, according to which a recording cartridge comprises a group of recording heads, which are different in the color of the inks they eject, and are staggered relative to each other in the direction in which recording medium is conveyed. This structural arrangement makes it possible to increase the ejection orifice pitch of each recording head relative to a desired image resolution. Therefore, it is superior in that a high resolution image can be easily formed with the use of this structural arrangement.

However, a structure such as the one disclosed in Japanese Laid-Open Patent Application 1-208,143/1989 makes a recording head relatively long compared to the size of the recording area covered by each color, creating a problem in that this structure makes apparatus dimension relatively large in terms of the secondary scanning direction.

On the other hand, a structure such as the one disclosed in Japanese Laid-Open Patent Applications 58-208143/1983 and 58-215352/1983 increases head size in the primary scanning direction, creating a problem in that this structure makes apparatus dimension increases in terms of the primary scanning direction. Increase of recording head size in the primary scanning direction results in increase in scanning time, being undesirable from the standpoint of high speed recording.

A structure such as the one disclosed in Japanese Laid-Open Patent Application 58-215,352/1983 causes head misalignment relative to each other when a plurality of heads are combined to form a recording head portion; in other words, it is liable to cause production errors. In particular, in the case of a recording head portion which ejects four different color inks, that is, Y, M, C, and Bk inks, the recording heads must be fixed in the order of Y-Bk-M-C-C-M-Bk-Y, with each recording head being displaced from the adjacent recording head by half a nozzle pitch. Assembling this type of recording head portion is liable to make the structure for aligning the plurality of recording heads complicated, as well as to increase the size of such a structure.

SUMMARY OF THE INVENTION

One of the primary objects of the present invention is to solve the various problems of a recording head capable of bidirectionally recording, for example, a problem that employment of such a recording head is liable to make a recording apparatus large, a problem that such a recording head is difficult to uniformly mass-produce, and the like problems, so that it becomes possible to provide a superior compact liquid ejecting recording head and a superior compact liquid ejecting recording apparatus, that is, a compact liquid ejecting recording head and a compact recording apparatus which are capable of producing a high resolution image of high quality in spite of their compact size.

Another object of the present invention is to provide a liquid ejecting recording head which records by ejecting a first liquid, and a second liquid different from the first liquid, from a group of ejection orifices and another group of ejection orifices, respectively, while being bidirectionally moved along the surface of recording medium, and is characterized in that the ejection orifices are divided into first and second groups in which the ejection orifices are aligned at a predetermined pitch, in first and second columns, and third and fourth columns, respectively, in the direction different from the direction in which the recording head is bidirectionally moved in the scanning manner, as well as in a plurality of rows, in the same direction as the direction in which the recording head is bidirectionally moved in the scanning manner; the first and second groups are placed adjacent to each other in such a manner that the first and third columns of ejection orifices in the first and second groups, respectively, are placed adjacent to each other; the first and second columns of ejection orifices, that is, the two columns of ejection orifices in the first group of ejection orifices, eject the first and second liquids, respectively, and the third and fourth ejection orifice columns, that is, the two columns of ejection orifices in the second group of ejection orifices, eject the first and second liquids, respectively; and the first and second groups of ejection orifices are staggered from each other in the column direction so that the first and second groups of ejection orifices compensate for each other in terms of the aforementioned primary scanning direction.

According to the above described liquid ejecting head, a color image with a desired high resolution can be produced simply by fixing the positional relationship between the first and second groups of ejection orifice columns. Further, the first and second groups of ejection orifice columns are disposed adjacent to each other in such a manner that the third and first ejection orifice columns in the first and second groups of ejection orifice columns, respectively, which eject the same liquid, or the first liquid, are placed adjacent to each other. Therefore, it is possible to make the third and first ejection orifice columns in the first and second groups of ejection orifice columns, respectively, share the same liquid supplying path, allowing recording head size to be reduced in both the primary and secondary scanning direction of the recording head.

As preferable additional structures to the above described structure arrangement, the following structures, the details of which will be described later, may be listed. Although these additional structures are capable of independently displaying remarkable effects, a structure created by combining a plurality of combinable structures among the aforementioned additional structures will be superior in terms of the object of the present invention, because of synergistic effects from the combination.

The above described liquid ejecting head may be provided with a common liquid chamber from which the aforementioned first liquid is supplied to both the third ejection orifice column of the first ejection orifice group, and the first ejection orifice columns of the second ejection orifice group.

The ejection orifice columns in the first and second ejection orifice groups do not need to be limited to those which eject either the first or second liquid. In other words, the first and second ejection orifice groups may comprise an ejection orifice column for ejecting a third liquid different from both the first and second liquids. In particular, when yellow, magenta, and cyan inks are used, the first liquid is desired to be yellow ink.

In order to achieve a higher level of image quality while bidirectionally printing, the ejection orifice columns in the first and second ejection orifice groups are desired to be arranged in such a manner that the two ejection orifice columns which are identical in the liquid they eject are virtually symmetrically disposed with respect to the third ejection orifice column of the first ejection orifice group (or first ejection orifice column of the second ejection orifice group).

The ejection orifice column for ejecting, for example, black ink, may be separately disposed from the first and second groups of ejection orifices.

The first and second groups of ejection orifices may be integrally placed on a single orifice plate. Also, groups of energy transducing elements for ejecting liquid from corresponding ejection orifice groups may also be placed on a single substrate. Integrating the components and portions of a recording head as described above eliminates the need for aligning the ejection orifice groups relative to each other, making it possible to easily provide a more precise recording head.

As the material for the substrate on which the groups of energy transducing elements are disposed, silicon is desirable. When forming the through holes through which liquid is supplied, by anisotropic etching, the crystal face orientation of silicon is desired to be <100> or <110>. The orifice plate material is desired to be photosensitive epoxy resin so that the aforementioned groups of ejection orifices can be easily formed in highly precise patterns of columns and rows.

Another object of the present invention is to provide a liquid ejecting recording head which records by ejecting a first liquid, and a second liquid different from the first liquid, from one group of ejection orifices and another group of ejection orifices, respectively, while being bidirectionally moved along the surface of recording medium, and is characterized in that it comprises an orifice plate provided with a plurality of ejection orifices aligned in a plurality of columns at a predetermined pitch in the direction different from the aforementioned primary scanning direction, and a substrate on which not only energy transducing elements for ejecting liquid are disposed in alignment with the ejection orifices of the orifice plate, but also liquid supplying paths for supplying the columns of ejection orifices of the orifice plate, and a driver circuit for driving the energy transducing elements, are disposed; the ejection orifices of the orifice plate are aligned in four columns in the direction different from the primary scanning direction, in the order of the first column which ejects the second liquid, the second column which ejects the first liquid, the third column which ejects the first liquid, and the fourth column which ejects the second liquid, in terms of the primary direction; and a single liquid supply path for supplying the first liquid supplies both the second and third columns of ejection orifices with the first liquid.

According to the above described recording head, it is unnecessary to adjust the positional relationship between the two groups of ejection orifices, making it easier to provide a highly precise head. Further, the liquid supplying path for one column of ejection orifices, and the liquid supplying path for another column of ejection orifices adjacent to the first column of ejection orifices can be integrated into a single liquid supplying path, making it possible to reduce recording head size in both the primary and secondary scanning directions. In addition, it is possible to place the aforementioned driver circuit in the area in which no liquid supplying holes are present.

In this specification, "recording medium" means not only such paper that is used by an ordinary printing apparatus, but also fabric, plastic film, metallic plate, and the like, in other words, a wide range of media capable of taking ink.

"Ink" means such liquid that is used to form an image, an abstract pattern, and the like, or to process printing medium, by being applied to printing medium.

"Pixel region" means a smallest unit of region to which a single or a plurality of droplets of ink to exhibit a primary or secondary color. Not only does it include a standard pixel, but also a super pixel and a sub-pixel. The number of scanning runs for completing a single pixel does not need to be one; it may be two or more.

Further, "process color" includes secondary color, that is, color exhibited by mixing three or more inks on printing medium.

As described above, according to the present invention, a color image with a desired high level of resolution can be produced simply by adjusting the positional relationship between the first and second groups of ejection orifices. Further, the first and second groups of ejection orifices can be placed adjacent to each other in such a manner that the ejection orifice column in the first ejection orifice group, which ejects the first liquid, and the ejection orifice column in the second ejection orifice group, which also eject the first liquid, are placed adjacent to each other, making it possible to make these two columns of ejection orifices share the same liquid path. Consequently, recording head size can be reduced in both the primary and secondary scanning directions, and it becomes easy to print at high speed, without causing unevenness in color, even in bidirectional printing.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, embodiments of the present invention will be described in detail with reference to the appended drawings.

Embodiment 1

Figure 1:
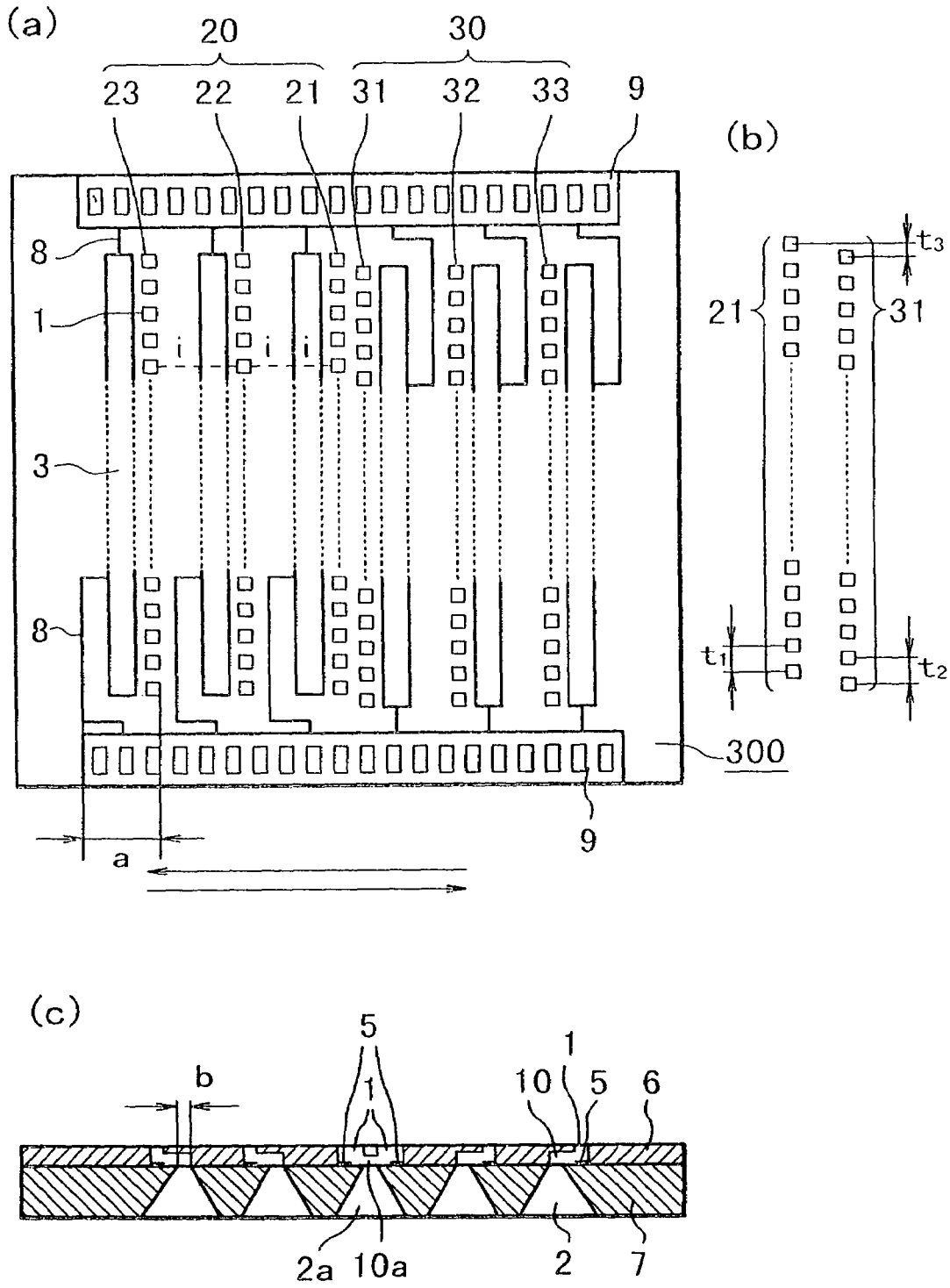
FIG. 1 is a schematic drawing which depicts the essential portion of the recording head in the first embodiment of the present invention.

FIG. 1 is a schematic drawing which shows the essential portion of the recording head in the first embodiment of the present invention. FIG. 1(*a*) is a top view, and FIG. 1(*b*) is a schematic drawing for describing the positioning of the ejection orifices. FIG. 1(*c*) is a sectional drawing. As is shown in FIG. 1(*c*), a recording head 300 in this embodiment comprises a substrate 7 inclusive of exothermal elements 5 as energy transducers, and an orifice plate 6 which has ejection orifices 1.

In this embodiment, the substrate 7 is formed of a single crystal with a crystal face orientation of <100>. Referring to FIG. 1(*a*), the top surface (surface which joins the surface of the orifice plate 6) of this substrate 7 has exothermic elements 5, a driver circuit 3 comprising driver transistors and the like for driving these exothermic elements 5, a contact pad 9 for a wiring plate, which will be described later, wires 8 and the like which connect the driver circuit 3 and contact pad 9, and the like. These components are formed with the use of a semiconductor manufacturing process. Further, the substrate 7 has five through holes, which were formed in the region across which the aforementioned driver circuit 3, exothermic elements 5, wiring 8, and contact pad 9 are not present, with the use of anisotropic etching. These holes constitute ink supplying holes 2 and 2*a* for supplying columns 21–23 and 31–33 of ejection orifices, correspondingly. Incidentally, FIG. 1(*a*) schematically shows the substrate 7 on which the orifice plate 6, which is virtually transparent, is placed. In the drawing, the aforementioned ink supplying holes are not illustrated.

In this embodiment, the orifice plate 6 placed on the substrate 7 is formed of photosensitive epoxy resin, and is provided with ejection orifices 1 and liquid paths 10, which were formed in alignment with the aforementioned exothermic elements, with the use of a process such as the one recorded in Japanese Laid-Open Patent Application 62-264,957/1987. More specifically, as is described in Japanese Laid-Open Patent Application 9-11,479/1997, after silicon oxide film or silicon nitride film was formed on the silicon substrate, the orifice plate with the through holes and liquid paths was formed, and the silicon oxide film or silicon nitride film was removed from the regions correspondent to the ink supplying holes, with the use of the aforementioned anisotropic etching. This method is desirable because it makes it possible to produce such an ink jet head that is inexpensive and yet highly precise.

Figure 2:
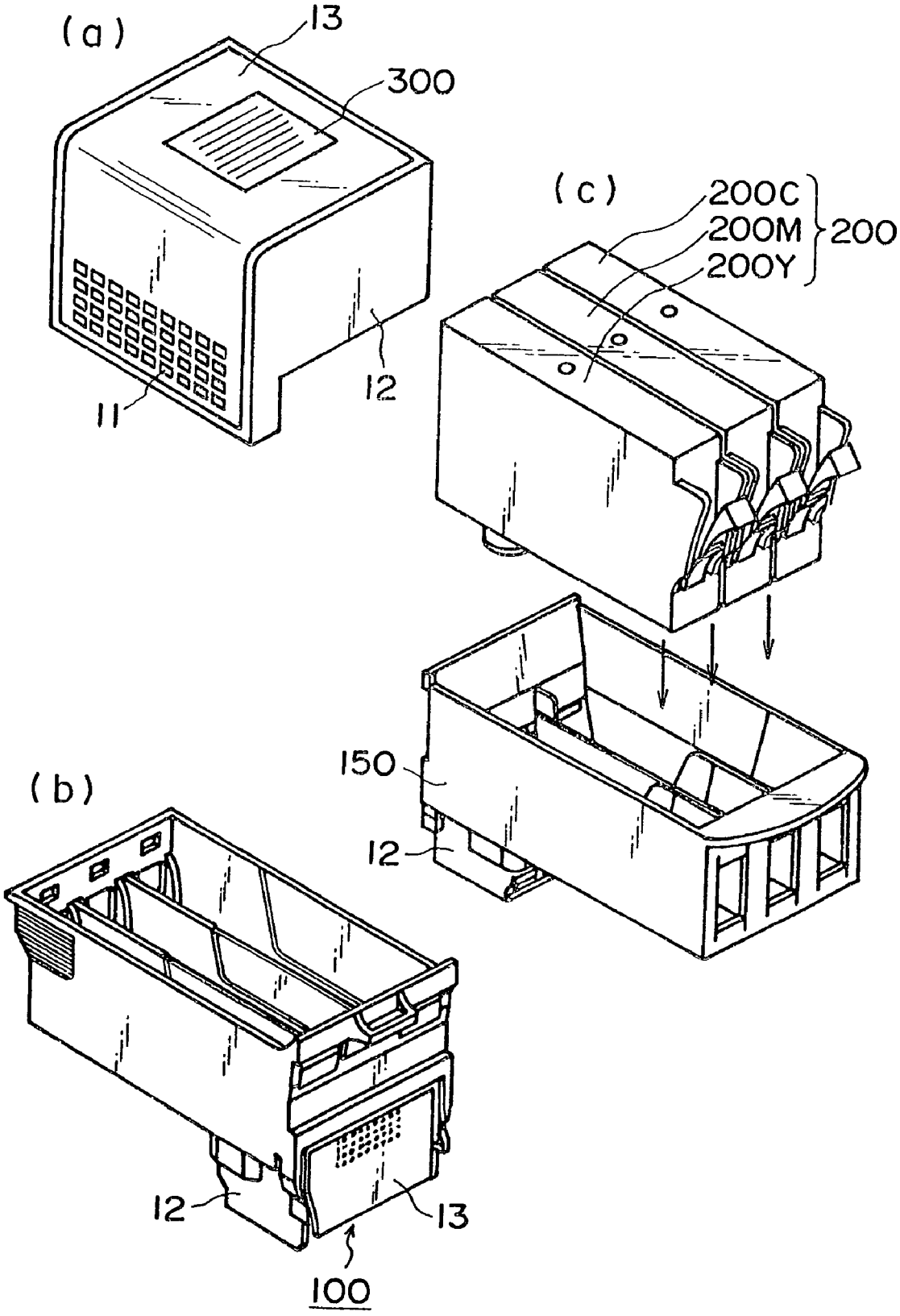
FIG. 2 is a schematic drawing which depicts an example of a recording head cartridge which holds the recording head in the first embodiment of the present invention.

The recording head 300 having the above described substrate 7 and orifice plate 6 records by ejecting liquid, for example, ink, from the ejection orifices 1 with the use of the pressure from the bubbles generated through the film boiling caused by the thermal energy applied by the electrothermal transducers 5. As shown in FIG. 2(*a*), the recording head 300 is fixed to an ink path member 12 connected to the aforementioned ink supplying holes, causing the contact pad to be placed in contact with the wiring plate 13. As the contact pad is placed in contact with the wiring plate 13, an electrical contact portion 11 of this wiring plate is placed in contact with the electrical contact portion of a recording apparatus which will be described later. As a result, the recording head 300 can receive driving signals or the like from the recording apparatus. FIG. 2(*b*) is a perspective view which shows an example of the recording head cartridge 100 equipped with the recording head 300 in accordance with the present invention. As shown in FIG. 2(*b*), this recording head cartridge is provided with an ink container holder 150 in which ink containers 200 (200Y, 200M, and 200C) for supplying inks to the aforementioned ink path member 12 are held.

Further, the recording head in this embodiment is provided with a plurality of ejection orifices 1 which are arranged with a predetermined pitch, forming plural columns 21–23, and 31–33, of ejection orifices, which are virtually parallel to each other. In FIG. 1(*a*), among the ejection orifice columns 21–23, the i-th ejection orifice in each column of ejection orifices, counting from the top side of the drawing, is aligned with the i-th ejection orifices in the other columns of ejection orifices, in the direction indicated in FIG. 1(*a*). In other words, the ejection orifice columns 21–23 in this embodiment are arranged so that the direction in which the i-th ejection orifice in each column of ejection orifices, counting from the top side of the drawing, is aligned with the i-th ejection orifices in the other columns of ejection orifices, coincides with the direction in which the recording head mounted in the recording apparatus, which will be described later, is moved in a scanning manner. The ejection orifice columns 21–23 make up a first ejection orifice group 20. The ejection orifice columns 31–33 are arranged in the same manner as the ejection orifice columns 21–23, and make up a second ejection orifice group 30, which is disposed adjacent to the first ejection orifice group 20.

In this embodiment, among the six ejection orifice columns constituting two groups of ejection orifices, the outermost ejection column of each group, that is, the ejection orifice columns 23 and 33, are assigned to eject cyan (C), and ejection orifice columns 22 and 32 are assigned to eject magenta (M). The innermost ejection orifice columns 21 and 31, which are adjacent to each other, are assigned to eject yellow (Y). Thus, yellow ink is supplied to the aforementioned ink supplying hole 2*a* (ink supplying hole located in the center) from the aforementioned ink container 200Y, and magenta ink is supplied to the ink supplying holes 2 adjacent to the ink supplying hole 2*a,* from the ink container 200M. Cyan ink is supplied to the outermost ink supplying holes 2 from the ink container 200C. As is evident from the above description, the ink supplying hole 2*a* in the center supplies two ejection orifice columns 21 and 31 with liquid, and functions, along with the liquid path 10*a,* as a common liquid chamber for the two ejection orifice columns 21 and 31.

As described above, in this embodiment, the ejection orifices are aligned in a plurality of columns, and the plurality of ejection orifice columns are divided into two groups which are identical to each other in the number of inks and colors of inks. Further, the ejection orifice columns and the driving circuits therefor are virtually symmetrically disposed with respect to the approximate center line which divides the ejection orifice columns into the first and second groups. With this arrangement, the through holes as the ink supplying holes 2 and 2*a,* driver circuits, exothermic elements, and the like, can be positioned on the substrate, with even intervals and a high level of spatial efficiency. In this embodiment, the size of each exothermic element 5 is 30 μm×30 μm, and the widths of the ejection orifice, driver circuit, and wiring (a in FIG. 1(*a*)) are 1.2 mm. The width of the top opening (b in FIG. 1(*c*)) of the ink supplying hole 2 is 0.2 mm. Thus, the substrate size may be 8.2 mm (=1.2×6+0.2×5). Being able to reduce the substrate size as described above is advantageous in that it makes it possible to reduce the capacity of the memory for holding the transfer data from a recording head, in proportion to the substrate size.

In addition, in this embodiment, as is evident from FIGS. 1(*a*) and 1(*b*), the first ejection orifice column group 20 and second ejection orifice column group 30 are staggered in the ejection orifice column direction so that the ejection orifices of the ejection orifice columns 21–23 which make up the first ejection orifice column group 20, and the ejection orifices of the ejection orifice columns which make up the ejection orifice column group 30, compensate among themselves in terms of the aforementioned scanning direction. Further, as is evident from FIG. 1(*b*), each of the ejection orifice columns of the first and second ejection orifice column groups has 128 ejection orifices which are aligned with an interval (pitch) of approximately 40 μm: $t_1=t_2\approx 40$ μm (1/600 inch). The ejection orifice column 21 is staggered from the ejection orifice column 31 in the secondary scanning direction of the recording head (in this embodiment, this direction coincides with the direction of each ejection orifice column) by exactly ½ pitch ($t_3=\frac{1}{2}t_1\approx 20$ μm).

At this point, an example of the recording method by this recording head will be described with reference to FIGS. 7 and 8.

In this embodiment, recording is effected by ejecting approximately 8 pls of ink from each nozzle. The recording apparatus (FIG. 10) in which the recording head in this embodiment is mounted is capable of operating in two different modes, that is, high speed mode and high resolution mode, to form an image.

Figure 7:
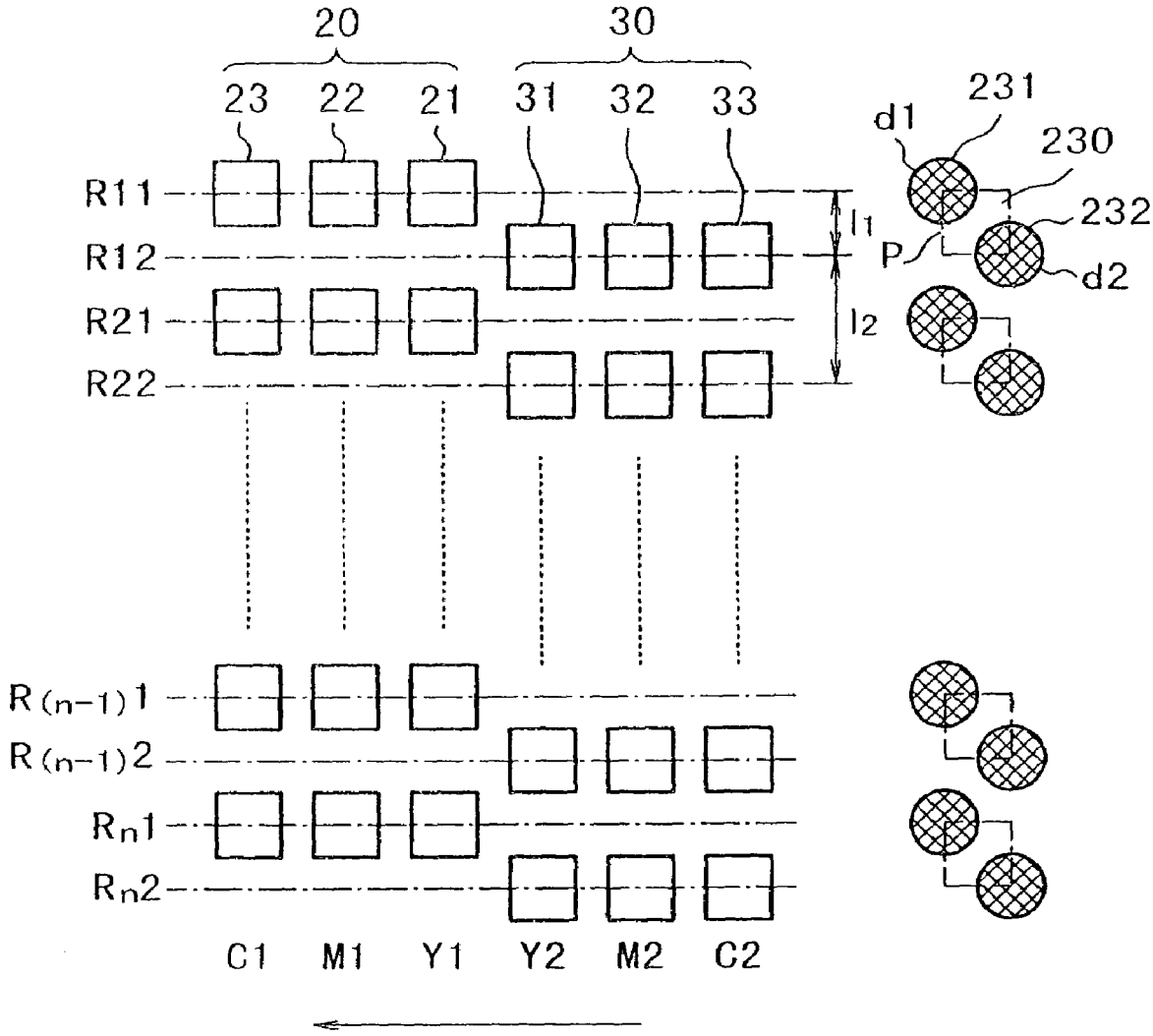
FIG. 7 is a schematic drawing which depicts an example of the relationship between the ejection nozzle position and pixel structure in an embodiment of the present invention.
Figure 8:
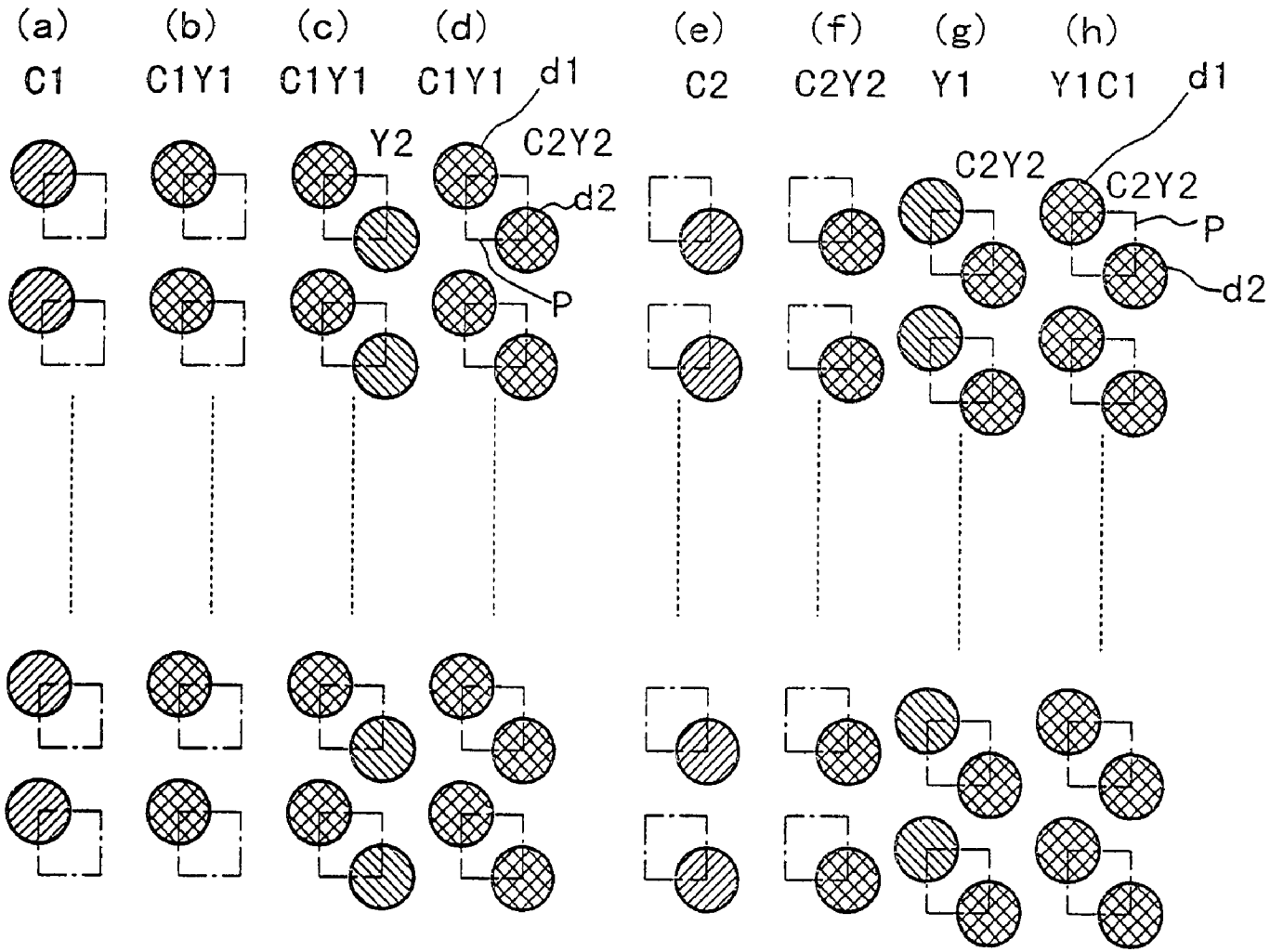
FIG. 8 is a schematic drawing which shows the image formation sequence through which an image is formed by a recording head in accordance with the present invention, while which prints bidirectionally.
Figure 9:
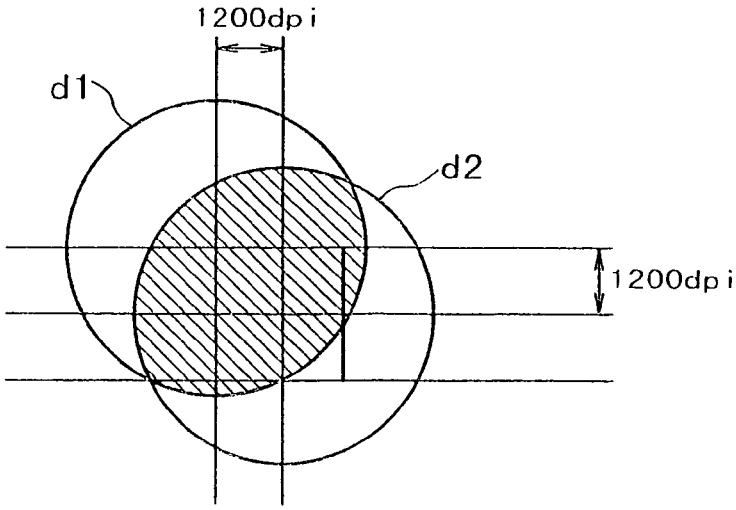
FIG. 9 is an enlarged drawing which shows the extent of dot expansion relative to a single pixel in FIG. 7.

FIGS. 7 and 8 are schematic drawings which depict an image forming operation in the aforementioned high speed mode. In this high speed mode, in order to reduce the time used for image processing and data transfer, two liquid droplets are deposited in each pixel in such a manner that the location on which one liquid droplet lands differs from the location on which the other liquid droplet lands. Incidentally, the pixel density in this embodiment is 600 pixels per inch in both the primary and secondary scanning direction. FIG. 7 shows a case in which cyan and yellow dots were recorded on the same spot. A pixel (p) 230 formed by the primary scanning lines (rasters) $R_{11}$ and $R_{12}$ is recorded as a pair of dots, that is, a dot deposited in a dot position 231 and a dot deposited in a dot position 232. Here, the dot positions are diagonally arranged; the dot position ($d_1$) 231 is at the top left corner of the pixel, and the dot position ($d_2$) 232 is at the bottom left corner of the pixel. In this drawing, the dot in the dot position $d_1$ and the dot in the dot position $d_2$ do not overlap with each other. In reality, however, it is common that the two dots partially overlap with each other as shown in FIG. 9 (hatched area).

Further, in this embodiment, in which a pixel p is formed by two rasters ($R_{(n-1)}$1, $R_{(n-1)}$2), a nozzle pitch 12 is approximately 40 μm (1/600 inch). Since the first ejection orifice column group 20 is staggered by half a pitch from the second ejection orifice column group 30 in the secondary scanning direction, an interval 11 between the adjacent two rasters is approximately 20 μm (1/1200 inch).

When a printing operation is carried out using only a single primary color, for example, magenta, an image is formed by ejecting a single droplet of magenta ink onto the dot position $d_1$ of each pixel p from correspondent ejection orifice of the ejection orifice column 22 (hereinafter, M1), and another single droplet of magenta ink onto the dot position $d_2$ of the same pixel p from the correspondent ejection orifice of the ejection orifice column 32 (hereinafter, M2), regardless of the scanning direction (in this case, two dots are the same in color, and therefore, the order in which two ink droplets are ejected does not affect the color exhibited by a combination of the two ink droplets).

However, when a printing operation is carried out in a secondary color, for example, green, as shown in FIG. 7, an image is formed by ejecting onto each pixel p a single droplet of liquid from the correspondent ejection orifice of the ejection orifice column 23 (hereinafter C1), a single droplet of liquid from the correspondent ejection orifice of the ejection orifice column 21 (hereinafter, Y1), a single droplet of liquid from the correspondent ejection orifice of the ejection orifice column 31 (hereinafter, Y2), and a single droplet of liquid from the correspondent ejection orifice of the ejection orifice column 33 (hereinafter, C2).

When printing in the forward direction, the order in which the ejection orifice columns pass a predetermined pixel p on a piece of recording medium is C1→Y1→Y2→C2. Therefore, the liquid droplets land on the pixel p in the order shown in FIGS. 8(*a*)→8(*d*). In the dot position $d_1$ of the pixel p, the liquid droplets land in the order of C→Y, and therefore, cyan color exhibited by the liquid droplet which lands first becomes dominant. On the other hand, in the dot position $d_2$, the liquid droplets land in the order of Y→C, and therefore, yellow color exhibited by the liquid droplet which lands first becomes dominant.

When printing in the returning direction, the order in which the ejection orifice columns pass a predetermined pixel p on a piece of recording medium is C2→Y2→Y1→C1. Therefore, the liquid droplets land on the pixel p in the order shown in FIGS. 8(*e*)→8(*h*). In the dot position $d_1$ of the pixel p, the liquid droplets land in the order of Y→C, and therefore, yellow color exhibited by the liquid droplet which lands first becomes dominant. On the other hand, in the dot position $d_2$, the liquid droplets land in the order of C→Y, and therefore, cyan color exhibited by the liquid droplet which lands first becomes dominant.

As is evident from the above description, in a high speed mode, each pixel is always painted by a dot dominated by cyan color and by a dot dominated by yellow color, regardless of scanning direction, and as a result, the pixel appears green, that is, a color exhibited by a balanced mixture between cyan and yellow.

In reality, the dot positions $d_1$ and $d_2$ overlap with each other across each pixel p and its adjacencies. Therefore, when printing in the forward direction in a high speed mode, dots are formed in the order of cyan dots by the liquid from C2, yellow dots by the liquid from Y2, yellow dots by the liquid from Y1, and cyan dots by the liquid from C1. When printing in the returning direction, dots are formed in the order of cyan dots by the liquid from C2, yellow dots by the liquid from Y1, yellow dots by the liquid from Y2, and cyan dots by the liquid from C2. As described above, the liquid depositing order is symmetrical, in other words, the order in which the inks are adhered is the same as in the forward direction. Therefore, the pixels appear uniformly green. In other words, even when printing is bidirectionally carried out, a printed image does not appear uneven in color.

Next, a high resolution mode will be described. In this mode, the resolution in the primary scanning direction is 600 pixels per inch, and the resolution in the secondary scanning direction is 1,200 pixels per inch. In monochromatic printing (printing in C, M, or Y), a single droplet of liquid is ejected per pixel. In this case, the pixels are divided into a group painted by a combination of C1, M1, and Y1, and a group painted by a combination of C2, M2, and Y2, by masking the image formation area. With this arrangement, the pixel density in the secondary scanning direction can be made to be 1,200 per inch, even though the nozzle density in each ejection orifice column is 600 per inch. Consequently, a highly precise image can be easily formed. Also in this high resolution mode, when printing in green, for example, pixels coated by a combination of C1 and Y1 (since liquids are adhered to recording medium in the order of C and Y, cyan becomes dominant) and pixels coated by a combination of C2 and Y2 (since liquids are adhered to recording medium in the order of Y and C, yellow becomes dominant), are present in mixture; pixels different in color are present in mixture. However, unevenness in color can be reduced to a hardly detectable level by evenly distributing the pixels different in color by proper masking.

The above described recording method is one of the bidirectional printing methods which can be carried out with the use of a liquid ejecting head in accordance with the present invention. Further, the recording mode used with the image forming method which uses a liquid ejecting head in accordance with the present invention does not need to be limited to the above described two recording modes.

Embodiment 2

Figure 3:
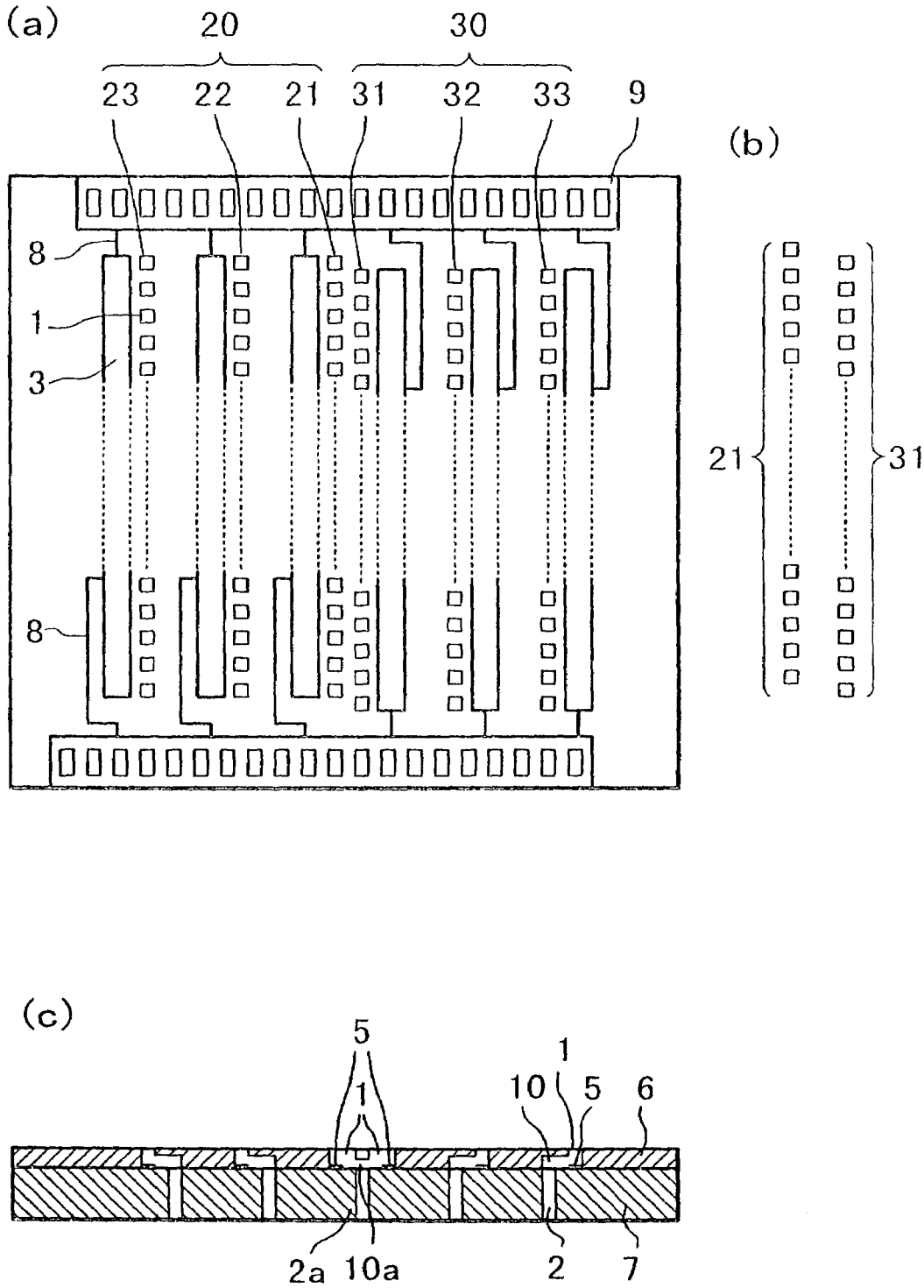
FIG. 3 is a schematic drawing which depicts the essential portion of the recording head in the second embodiment of the present invention.
Figure 4:
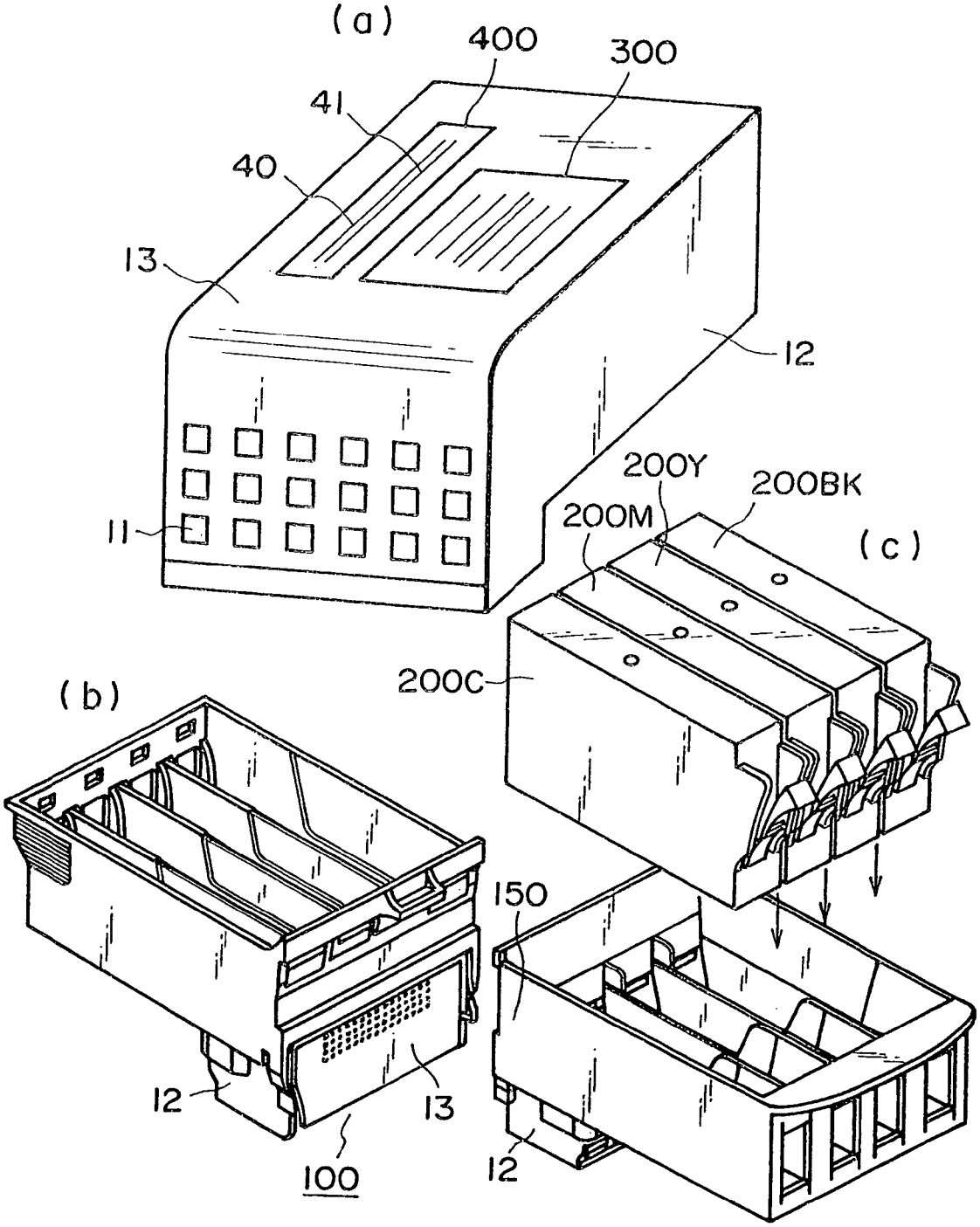
FIG. 4 is a schematic drawing which depicts an example of a recording head cartridge which holds the recording head in the second embodiment of the present invention.

FIGS. 3 and 4 are drawings which show the recording head in the second embodiment of the present invention, and a recording head cartridge in which this recording head is mounted. In the drawings, the components and portions which are the same in function as those in the first embodiment are given the same referential codes as those in the first embodiment, and their detailed descriptions will not be given. FIG. 3 is a schematic drawing which depicts the essential portion of the recording head. FIG. 3(*a*) is a schematic drawing as seen from the top, and FIG. 3(*b*) is a schematic drawing which depicts the positioning of the ejection orifices. FIG. 3(*c*) is a sectional view. FIG. 4(*a*) is a perspective view of the recording head illustrated in FIG. 3, which is fixed to an ink path member 12, and FIG. 4(*b*) is a perspective view of an example of a recording head cartridge 100 equipped with the recording head 300 in accordance with the present invention. FIG. 4(*c*) is a perspective view of the recording head cartridge illustrated in FIG. 4(*b*), and ink containers removably installable in this recording head cartridge.

Firstly, this embodiment is different from the first embodiment in that a silicon substrate with a crystal face orientation of <110> is used. In this embodiment, when forming ink supplying holes 2 and 2*a* by etching, the etching progresses perpendicularly to the substrate. Therefore, it is easy to form the ink supplying holes 2 and 2*a* in this embodiment, which are uniform in cross-section perpendicular to the thickness direction of the substrate as shown in FIG. 3(*c*). Thus, the substrate size is determined by the patterns formed on the substrate surface, making it possible to further reduce the recording head size. Although the ink supplying holes shaped as shown in FIG. 3(*c*) can be easily formed by the above described etching, they may be formed by other methods, for example, sand blasting or laser process. When forming the ink supplying holes shaped as shown in FIG. 3(*c*) using a method other than etching, it is not mandatory to use silicon with a crystal face orientation of <110> as the material for the substrate.

Also, in this embodiment, in addition to the recording head 300 capable of ejecting the aforementioned Y, M, and C inks, a recording head 400 having ejection orifice columns 40 and 41 for ejecting black ink (Bk) is fixed to an ink path member 12, forming together a recording head cartridge capable of ejecting four inks different in color. Ordinarily, black ink is not used to produce secondary colors. Therefore, it is unnecessary to symmetrically place the two ejection orifice columns for black ink. Further, in order to improve the recording speed in monochromatic recording, the recording head for black ink is provided with a larger number of nozzles than the recording heads for the other color inks. Further, the ejection orifice columns 40 and 41 are arranged so that they also compensate for each other in terms of the primary scanning direction as the ejection orifice columns 21 and 31 do, making it possible to record at a resolution level equivalent to twice the nozzle arrangement density in each ejection orifice column.

Also in this embodiment, a printing operation can be carried out in the recording modes in the above described first embodiment.

Embodiment 3

Figure 5:
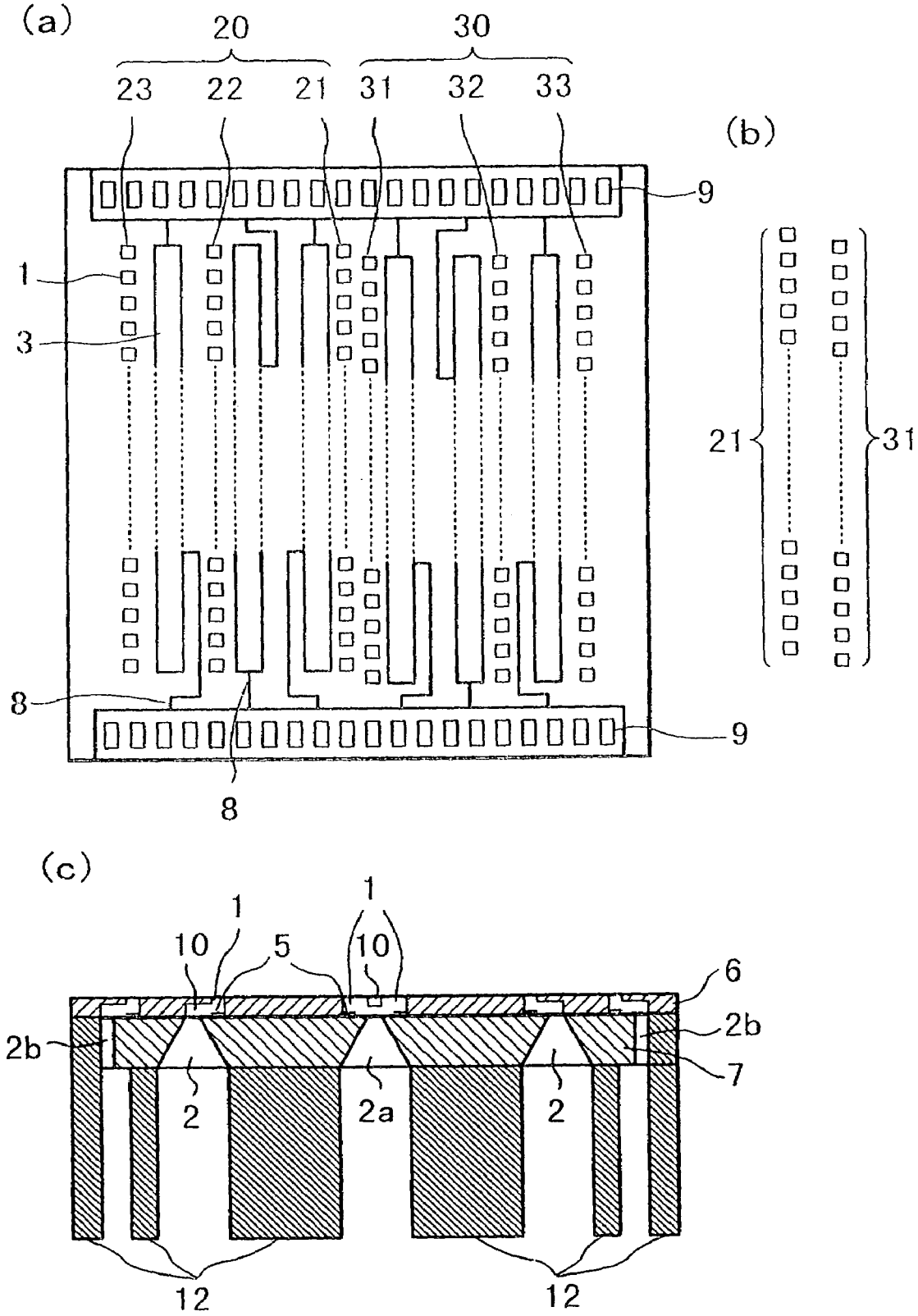
FIG. 5 is a schematic drawing which depicts the essential portion of the recording head in the third embodiment of the present invention.

FIG. 5 is a drawing which shows the recording head in the third embodiment of the present invention. In this drawing, the components and portions which are the same in function as those in the first and second embodiments are given the same referential codes as those in the first and second embodiments, and their detailed descriptions will be not be given. FIG. 5 is a schematic drawing which depicts the essential portion of the recording head. FIG. 5(*a*) is a schematic drawing as seen from the top, and FIG. 5(*b*) is a schematic drawing which depicts the positioning of the ejection orifices. FIG. 5(*c*) is a sectional view.

This embodiment is different from the first and second embodiments in that the number of through holes provided in the substrate 7 is three. The ink supplying holes 2b correspondent to the two outermost ejection orifice columns are formed by the edge portions of the substrate 7 and the ink path member 12. With this arrangement, it is possible to further reduce the substrate size of the recording head 300.

Embodiment 4

Figure 6:
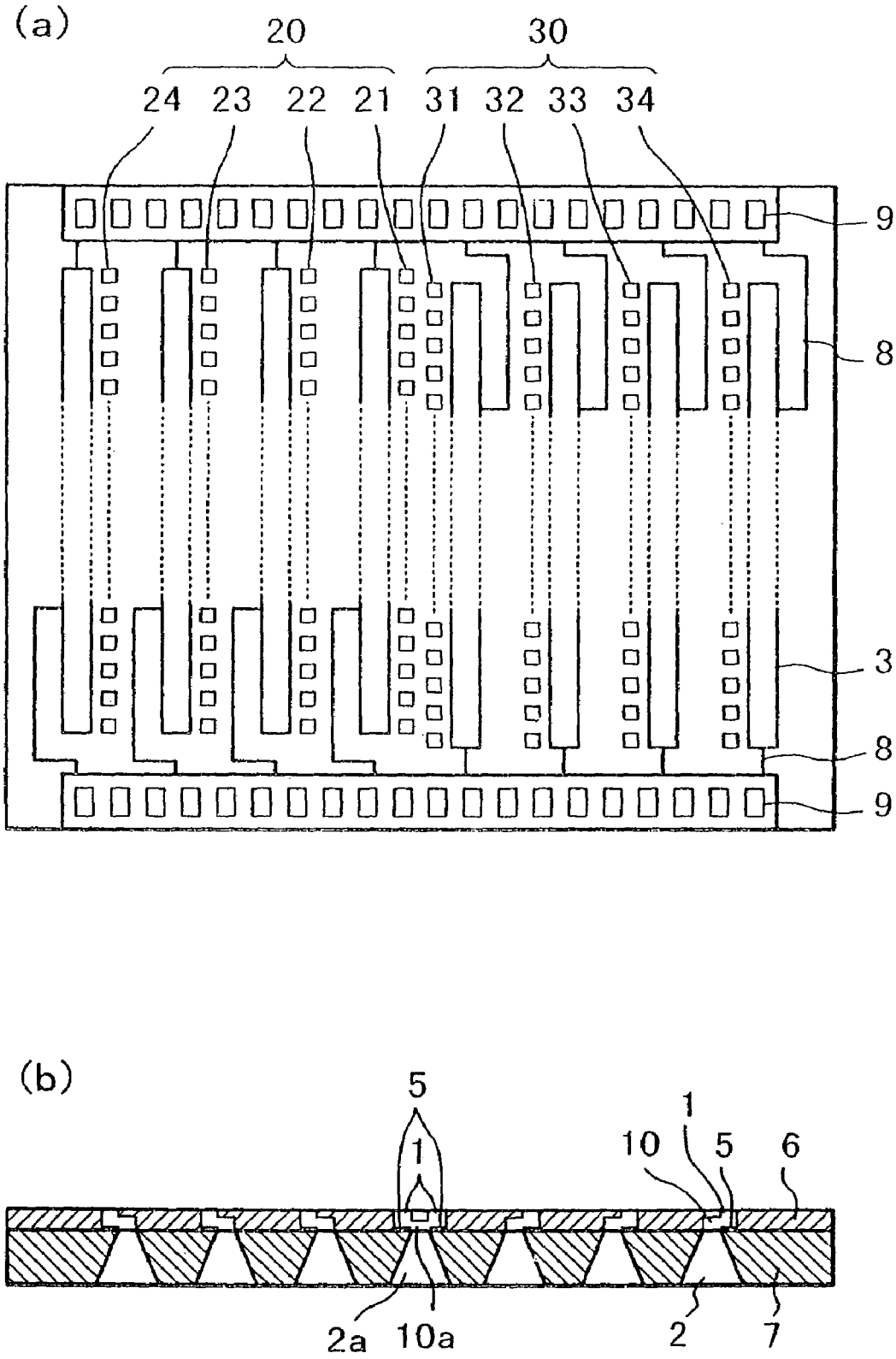
FIG. 6 is a schematic drawing which depicts the essential portion of the recording head in the fourth embodiment of the present invention.

FIG. 6 is a drawing which shows the recording head in the fourth embodiment of the present invention. In this drawing, the components and portions which are the same in function as those in the first and second embodiments are given the same referential codes as those in the first and second embodiments, and their detailed descriptions will be not be given. FIG. 6 is a schematic drawing which depicts the essential portion of the recording head. FIG. 6(*a*) is a schematic drawing as seen from the top, and FIG. 6(*b*) is a sectional view.

In this embodiment, the ejection orifice columns 24 and 34 for ejecting black ink (Bk) are placed in the first and second ejection orifice column groups, respectively.

According to this embodiment, the minimum requirement for carrying out the recording method for reducing the unevenness in color, which was described in detail regarding the first embodiment, in a bidirectional printing, is that one of each pair of ejection orifice columns which deposit liquids in an overlapping manner and are different in liquid is included in the first group of ejection orifices, and the other of the pair is included in the second group of ejection orifices; as long as this requirement is satisfied, the aforementioned effect, that is, reduction in the unevenness in color, can be realized. However, in order to produce an image with far less unevenness in color, it is desired that one of each pair of ejection orifice columns which eject liquids in an overlapping manner, and the other of the pair, are symmetrically arranged as in each of the preceding embodiments described above.

In each of the preceding embodiments described above, the present invention was described with reference to cyan, magenta, and yellow inks, which are most widely used in the field of ink jet recording, as the liquids deposited in an overlapping manner. However, cyan, magenta, and yellow inks, which are less in saturation, may be included among the liquids to be deposited in an overlapping manner. Further, the aforementioned inks of primary color, which are deposited in combination to exhibit blue, red, and the like colors may be different from those used in this embodiment. In other words, the combination of liquids described, in this specification, different in "type" may a combination of inks different in color, as well as a combination of inks which are the same in color but different in density.

In the preceding embodiments of the present invention, the first and second columns of ejection orifices were placed on the same orifice plate, or the energy transducing elements for ejecting liquid from the ejection orifices in the first column, and the energy transducing elements for ejecting liquid from the ejection orifices in the second column, were placed on the same orifice plate. However, the first and second columns of ejection orifices may be placed on different recording heads which are combined later. With this arrangement, all that is necessary is to adjust the position of the two heads relative to each other to meet the requirements of the present invention. Nevertheless, the structures in the preceding embodiments are preferable in that they eliminate the need for aligning the ejection orifice columns in two different recording heads.

Miscellany

Figure 10:
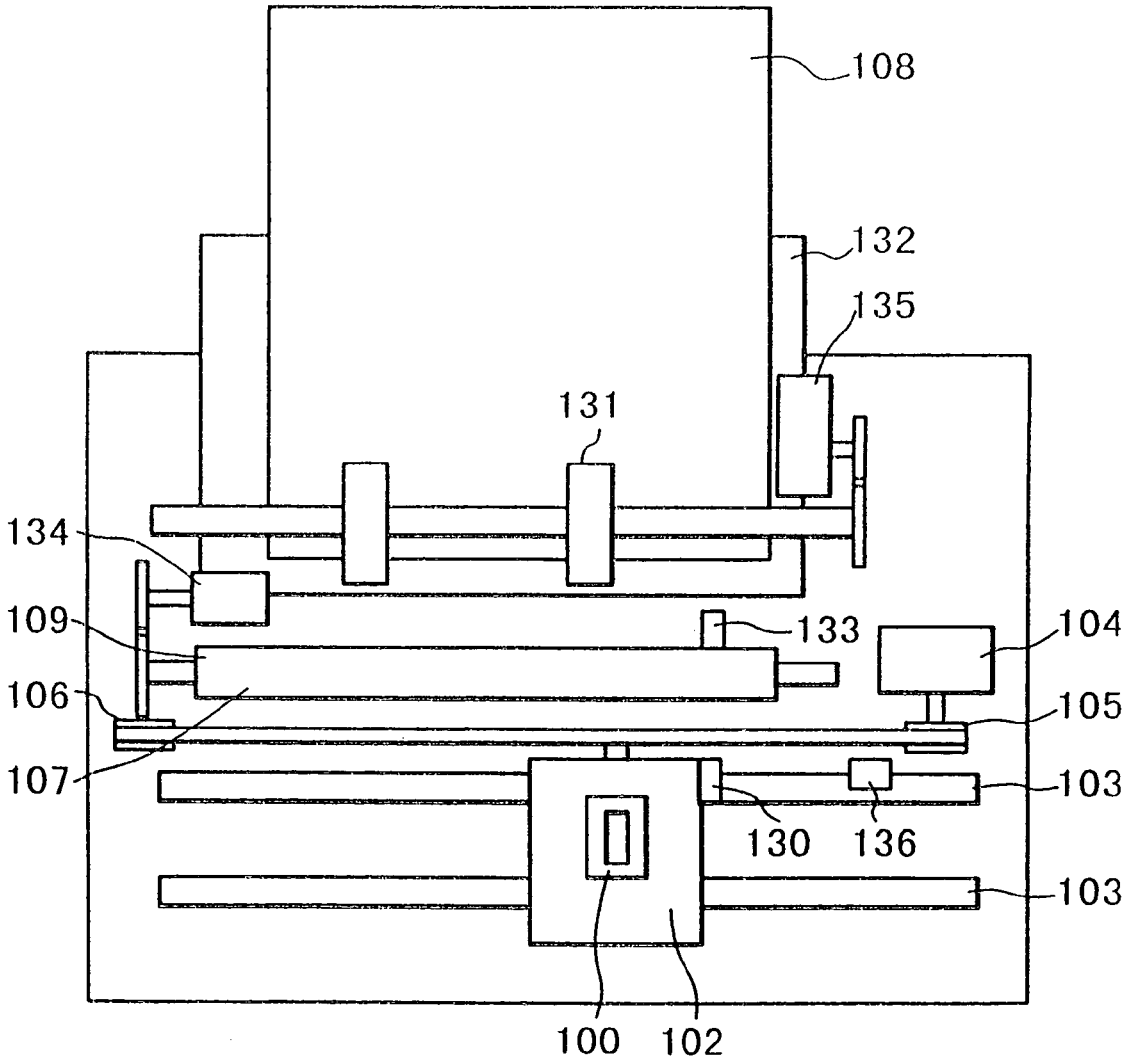
FIG. 10 is a schematic drawing of an example of a recording apparatus in which a liquid ejecting recording head in accordance with the present invention can be mounted.

Lastly, a liquid ejecting recording apparatus in which the above described recording heads or recording heads in the preceding embodiments of the present invention can be installed will be described. FIG. 10 is a schematic drawing which depicts an example of a recording apparatus in which a liquid ejecting recording head in accordance with the present invention is installable.

In FIG. 10, a head cartridge 100, which is removably installable in the recording apparatus, is in the recording apparatus. The head cartridge 100 has a recording head unit 50, ink containers 200, and a connector (unillustrated) for sending or receiving signals for driving the head, and the like.

The head cartridge, which is removably installable in a carriage 102 is in the predetermined position in the carriage 102. The carriage 102 is provided with an electrical connector portion, through which and the aforementioned connector of the head cartridge, driving signals and the like are transmitted to the cartridge 100.

The carriage 102 is supported by a guide shaft 103 provided in the main assembly of the recording apparatus, extending in the primary scanning direction, and is guided by the guide shaft 103 in a reciprocative manner. It is driven by a primary scanning motor 104 through a driving mechanism comprising a motor pulley 105, a follower pulley 106, a timing belt 107, and the like, while being controlled in terms of its position. Further, it is provided with a home position sensor 130. The provision of the home position sensor 130 makes it possible to detect the position of the carriage 102 when the home position sensor 130 of the carriage 102 passes a shielding plate 136.

As a pickup roller 131 is rotated by a sheet feeder motor 135 through a gear train, recording media 108 such as pieces of printing paper, thin plate of plastic, or the like, are fed into the main assembly of the recording apparatus, while being separated one by one, by an automatic sheet feeder (hereinafter, ASF). Then, each recording medium 108 is conveyed (in the secondary scanning direction) through the position (printing station) where it faces the head cartridge surface with ejection orifices by the rotation of a pair of conveyer rollers 109. The conveyer rollers 109 are rotated by the rotation of an LF motor 134. During this conveyance of the recording medium 103, whether or not a recording medium 108 is fed, and whether or not the leading edge of the recording medium 108 is properly positioned in terms of timing and location, are determined when the recording medium 108 passes a paper end sensor 133, which also is used to determine where the true trailing end of the recording medium 108 is present, in order to ultimately determine the current recording point on the recording medium 108.

The recording medium 108 is supported from behind by a platen (unillustrated) so that it forms a flat printing surface in the printing station. Incidentally, after being installed in the carriage 102, the head cartridge 100 is held in such a manner that its portion with the surface with the ejection orifices projects downward from the carriage 102, with the surface with the ejection orifices being parallel to the recording medium 108 stretched between the aforementioned pair of conveyer rollers.

The head cartridge 100 is mounted in the carriage 1 in such a manner that the direction of the ejection orifice column becomes different from the direction in which the carriage is moved in the scanning manner, and recording is effected by ejecting liquid from these columns of ejection orifices. Although the head cartridges 100 in the preceding embodiments were provided electrothermal transducers for generating the thermal energy used for ejecting ink, it is obvious that ink may be ejected using a method different from the electrothermal transducer based method, for example, a method in which ink is ejected using piezoelectric elements.

While the invention has been described with reference to the structures disclosed herein, it is not confined to the details set forth, and this application is intended to cover such modifications or changes as may come within the purposes of the improvements or the scope of the following claims.

What is claimed is:

1. A liquid ejection recording head for effecting recording while scanning a recording material bi-directionally, said liquid ejection recording head comprising:

first, second and third liquid supply openings provided in a common substrate in the order named in a given direction;

a first ejection outlet array including a plurality of ejection outlets in fluid communication with said second liquid supply opening, said first ejection outlet array being disposed on a side of said second liquid supply opening facing away from the direction;

a second ejection outlet array including a plurality of ejection outlets in fluid communication with said first liquid supply opening, said second ejection outlet array being disposed on a side of said first liquid supply opening;

a third ejection outlet array including a plurality of ejection outlets in fluid communication with said second liquid supply opening, said third ejection outlet array being disposed on a side of said second liquid supply opening facing the direction;

a fourth ejection outlet array including a plurality of ejection outlets in fluid communication with said third liquid supply opening, said fourth ejection outlet array being disposed on a side of said third liquid supply opening;

wherein the ejection outlets of said first ejection outlet array and the ejection outlets of said second ejection outlet array are aligned with each other with respect to the direction;

wherein the ejection outlets of said third ejection outlet array and the ejection outlets of said fourth ejection outlet array are aligned with each other with respect to the direction;

wherein the ejection outlets of said first ejection outlet array and the ejection outlets of said third ejection outlet array are offset from each other with respect to the direction so as to supplement each other with respect to a direction in which the ejection outlets are arranged; and wherein the same kind of liquid is supplied through said first liquid supply opening and said third liquid supply opening.

2. A liquid ejection recording head according to claim 1, wherein the same kind of liquid is yellow ink.

3. A liquid ejection recording head according to claim 1, further comprising a fifth ejection outlet array for ejecting black liquid.

4. A liquid ejection recording head according to claim 1, wherein said first, second, third and fourth ejection outlet arrays are provided on one orifice plate.

5. A liquid ejection recording head according to claim 4, wherein said orifice plate is made of a photosensitive epoxy resin material.

6. A liquid ejection recording head according to claim 1, further comprising a plurality of energy conversion elements for ejecting liquid from said ejection outlets on said common substrate.

7. A liquid ejection recording head according to claim 6, wherein said common substrate has a crystal face orientation of a <100> plane.

8. A liquid ejection recording head according to claim 6, wherein said common substrate has a crystal face orientation of a <110> plane.

9. A liquid ejection recording head according to claim 7, wherein said first, second and third liquid supply openings are formed by anisotropic etching.

10. A liquid ejection recording head according to claim 8, wherein said first, second and third liquid supply openings are formed by anisotropic etching.

11. A liquid ejection recording head according to claim 6, wherein said energy conversion elements are electrothermal transducers for generating thermal energy for ejecting liquid from said ejection outlets.

12. A liquid ejection apparatus comprising a carriage for carrying a liquid ejection recording head as claimed in claim 1.

13. A liquid ejection recording head for effecting recording while scanning a recording material bi-directionally, said liquid ejection recording head comprising:

first, second and third liquid supply openings provided in a common substrate in the order named in a given direction;

a first ejection outlet array including a plurality of ejection outlets in fluid communication with said second liquid supply opening, said first ejection outlet array being disposed on a side of said second liquid supply opening facing away from the direction;

a second ejection outlet array including a plurality of ejection outlets in fluid communication with said first liquid supply opening, said second ejection outlet array being disposed on a side of said first liquid supply opening;

a third ejection outlet array including a plurality of ejection outlets in fluid communication with said second liquid supply opening, said third ejection outlet array being disposed on a side of said second liquid supply opening facing the direction;

a fourth ejection outlet array including a plurality of ejection outlets in fluid communication with said third liquid supply opening, said fourth ejection outlet array being disposed on a side of said third liquid supply opening;

wherein the ejection outlets of said first ejection outlet array and the ejection outlets of said second ejection outlet array are aligned with each other with respect to the direction;

wherein the ejection outlets of said third ejection outlet array and the ejection outlets of said fourth ejection outlet array are aligned with each other with respect to the direction;

wherein the ejection outlets of said first ejection outlet array and the ejection outlets of said third ejection outlet array are offset from each other with respect to the direction so as to supplement each other with respect to a direction in which the ejection outlets are arranged;

wherein the same kind of liquid is supplied through said first liquid supply opening and said third liquid supply opening; and wherein a volume of each liquid droplet ejected through the ejection outlets of said first ejection outlet array, a volume of each liquid droplet ejected through the ejection outlets of said second ejection outlet array, a volume of each liquid droplet ejected through the ejection outlets of said third ejection outlet array, and a volume of each liquid droplet ejected through the ejection outlets of said fourth ejection outlet array are substantially the same.

14. A liquid ejection recording head for effecting recording while scanning a recording material bi-directionally, said liquid ejection recording head comprising:

first, second and third liquid supply openings provided in a common substrate in the order named in a given direction;

a first ejection outlet array including a plurality of ejection outlets in fluid communication with said second liquid supply opening, said first ejection outlet array being disposed on a side of said second liquid supply opening facing away from the direction;

a second ejection outlet array including a plurality of ejection outlets in fluid communication with said first liquid supply opening, said second ejection outlet array being disposed on a side of said first liquid supply opening;

a third ejection outlet array including a plurality of ejection outlets in fluid communication with said second liquid supply opening, said third ejection outlet array being disposed on a side of said second liquid supply opening facing the direction;

a fourth ejection outlet array including a plurality of ejection outlets in fluid communication with said third liquid supply opening, said fourth ejection outlet array being disposed on a side of said third liquid supply opening;

wherein the ejection outlets of said first ejection outlet array and the ejection outlets of said second ejection outlet array are aligned with each other with respect to the direction;

wherein the ejection outlets of said third ejection outlet array and the ejection outlets of said fourth ejection outlet array are aligned with each other with respect to the direction;

wherein the ejection outlets of said first ejection outlet array and the ejection outlets of said third ejection outlet array are offset from each other with respect to the direction so as to supplement each other with respect to a direction in which the ejection outlets are arranged.

* * * * *

UNITED STATES PATENT AND TRADEMARK OFFICE

CERTIFICATE OF CORRECTION

PATENT NO. : 7,118,193 B2
APPLICATION NO. : 11/235279
DATED : October 10, 2006
INVENTOR(S) : Mineo Kaneko et al.

It is certified that error appears in the above-identified patent and that said Letters Patent is hereby corrected as shown below:

ON THE TITLE PAGE

At Item 30, Foreign Application Priority Data, "1999-364078" should read --11-364078--.

At Item 56, Other Publications, insert --Patent Abstracts of Japan, Hitotsubashi Hiroo, "Image Recorder," Dec. 14, 1983.--.

COLUMN 1

Line 7, "467, now allowed." should read --467.--.
Line 48, "58-208,143/1983" should read --58-208143/1983--.
Line 53, "58-179,653/1983" should read --58-179653/1983--.

COLUMN 2

Line 1, "58-215," should read --58-215--.
Line 13, "1-208,143/1989" should read --1-208143/1989--.
Line 23, "increases" should read --increase--.
Line 29, "58-215,352/1983" should read --58-215352/1983--.

COLUMN 3

Line 34, "direction" should read --directions--.

Signed and Sealed this

Twenty-seventh Day of May, 2008

JON W. DUDAS
*Director of the United States Patent and Trademark Office*